US006089197A

United States Patent [19]

Lange et al.

[11] Patent Number: 6,089,197

[45] Date of Patent: Jul. 18, 2000

[54] ELECTROMAGNETIC ACTUATOR FOR AN ENGINE VALVE, INCLUDING AN INTEGRATED VALVE SLACK ADJUSTER

[75] Inventors: Holger Lange, Aachen; Michael Schebitz, Eschweiler, both of Germany

[73] Assignee: FEV Motorentechnik GmbH, Aachen, Germany

[21] Appl. No.: 09/440,091

[22] Filed: Nov. 15, 1999

Related U.S. Application Data

[63] Continuation of application No. 09/335,055, Jun. 16, 1999.

[51] Int. Cl.[7] ..... F01L 9/04; F01L 1/24

[52] U.S. Cl. ..... 123/90.11; 123/90.55; 251/129.1; 251/129.16

[58] Field of Search ..... 123/90.11, 90.55; 251/129.01, 129.1, 129.16

[56] References Cited

U.S. PATENT DOCUMENTS

| | | | |
|---|---|---|---|
| 4,515,343 | 5/1985 | Pischinger et al. | 251/48 |
| 5,131,624 | 7/1992 | Kreuter et al. | 251/129.18 |
| 5,611,303 | 3/1997 | Izuo | 123/90.11 |
| 5,762,035 | 6/1998 | Schebitz | 123/90.11 |
| 5,887,553 | 3/1999 | Ballmann et al. | 123/90.11 |

FOREIGN PATENT DOCUMENTS 814238 12/1997 European Pat. Off. .

*Primary Examiner*—Weilun Lo
*Attorney, Agent, or Firm*—Venable; Gabor J. Kelemen

[57] ABSTRACT

An electromagnetic actuator includes a housing; two spaced electromagnets disposed in the housing and having respective pole faces oriented toward one another; an armature movable between the pole faces; an opening spring and a closing spring exerting oppositely directed forces to the armature; a supply arrangement for delivering hydraulic oil under pressure; and an armature stem affixed to the armature and having a free end oriented toward a free end of a valve stem of an engine valve of an internal-combustion engine. The valve stem and the armature stem are urged toward one another by the opening and closing springs. The armature stem is provided with a channel adapted to be supplied with hydraulic oil from the supply arrangement. Further, a guide is provided for supporting and guiding the armature stem in displacements thereof. A piston-and-cylinder unit, including a cylinder chamber, is disposed between the free and of the armature stem and the free end of the valve stem for transmitting displacement forces from the armature stem to the valve stem by the piston-and-cylinder unit. A valve assembly is provided which has a first state in which hydraulic communication is maintained between the supply arrangement and the cylinder chamber via the channel in the armature stem and a second state in which hydraulic communication is blocked between the supply arrangement and the cylinder chamber.

9 Claims, 1 Drawing Sheet

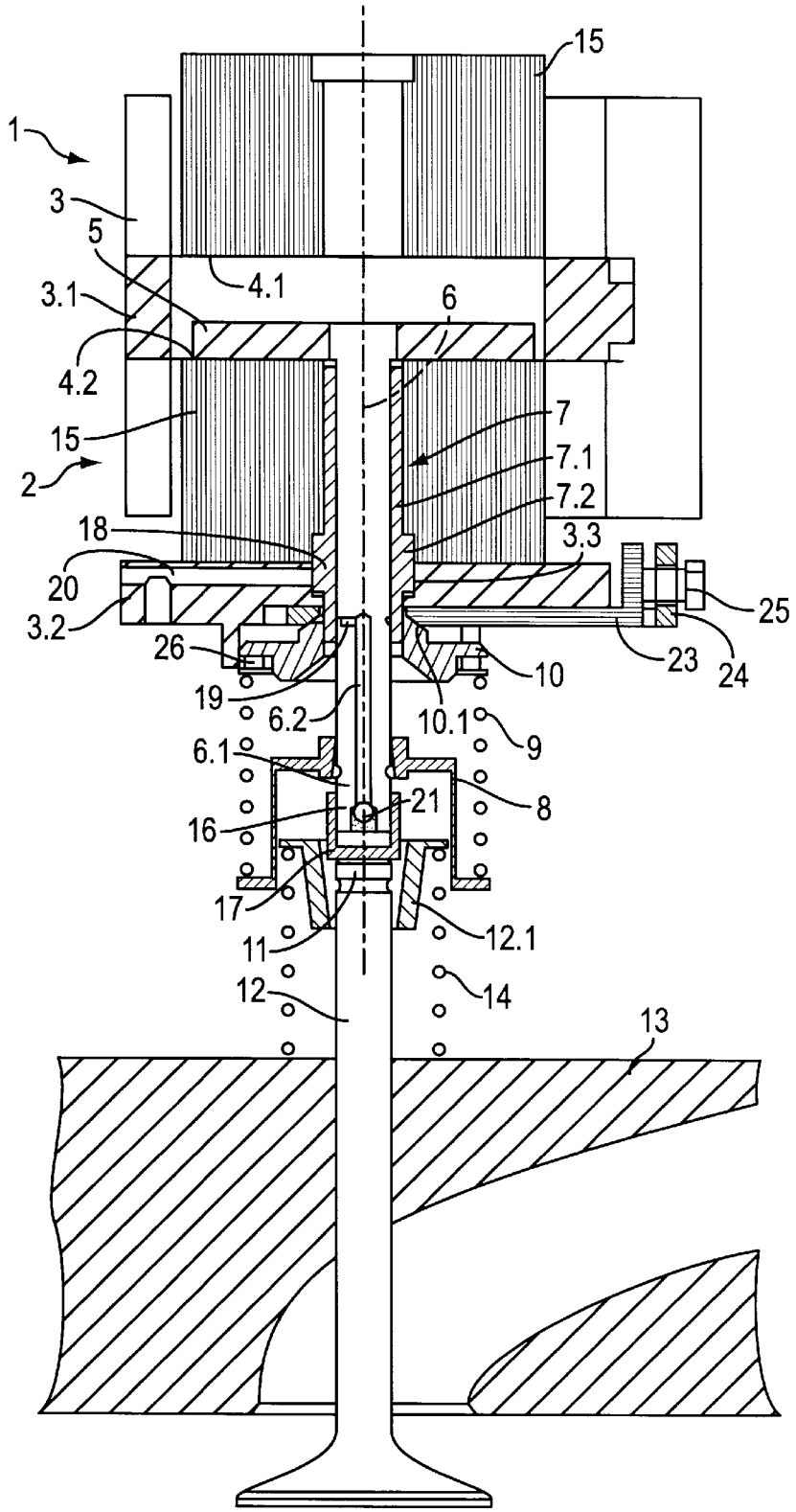
FIGURE

ELECTROMAGNETIC ACTUATOR FOR AN ENGINE VALVE, INCLUDING AN INTEGRATED VALVE SLACK ADJUSTER

CROSS REFERENCE TO RELATED APPLICATION

This is a continuation of pending U.S. application Ser. No. 09/335,055, filed Jun. 16, 1999.

This application claims the priority of German Application No. 198 26 832.7 filed Jun. 16, 1998, which is incorporated herein by reference.

BACKGROUND OF THE INVENTION

U.S. Pat. No. 4,777,915 discloses an electromagnetic actuator for operating a engine valve of a piston-type internal-combustion engine. The actuator has two spaced electromagnets, between the pole faces of which an armature is movable back and forth against the force of resetting springs. The armature is affixed to the stem of the engine valve. The upper electromagnet serves as a closing magnet while the lower electromagnet serves as an opening magnet, so that by an alternating energization of the closing magnet and the opening magnet the engine valve may be closed and opened. Since due to temperature changes and/or wear the opening and, in particular, the closing conditions for the valve and the predetermined valve clearance (valve slack) change, in such a system a piston-and-cylinder unit is provided which shifts the closing magnet in accordance with operational requirements whereby the valve clearance is changed. Such a solution, however, involves the disadvantage that by changing the setting of the valve clearance the stroke of the setting unit, that is, the motion path of the armature between the two pole faces of the electromagnets also changes which is impermissible in case of throttle-less load control in internal-combustion engines, because the charge quantity in the cylinder would thereby change as a function of temperature and time.

German Offenlegungsschrift (application published without examination) No. 197 02 485 discloses an electromagnetic actuator which includes a valve slack adjuster in which the electromagnets are arranged at a fixed distance from one another in a housing which also includes the valve opening spring. For performing valve slack adjustments, a hydraulic setting device is provided which is coupled with a hydraulic fluid supplying device by means of which the housing may be shifted relative to the engine valve coupled with the valve closing spring. By virtue of this arrangement a compensation of the valve clearance may be effected without changing the motion geometry of the armature and thus without changing the stroke of the setting unit. The housing is adjusted corresponding to temperature or wear-caused changes so that, for example, a chatter is avoided. Such a system, however, requires a significant technological and structural outlay since the setting unit must also serve for securing and guiding the actuator housing.

European Published Patent Application No. 814 238 discloses an electromagnetic actuator for a engine valve in which the bottom of the housing which surrounds the electromagnets has an axial guiding passage in which a conventional clearance compensating element, formed of a piston and a cylinder, is displaceably arranged. One end of the compensating element engages the outer end of the armature stem, while the other end of the compensating element engages the outer end of the valve stem. Since the clearance compensating element has a relatively large structural volume and, accordingly, a relatively large mass, this construction has the disadvantage that during valve operation the clearance compensating element is reciprocated with the operating frequency of the actuator. In view of the accelerations, the mass forces produced by the clearance compensating element are not negligible. Since such forces oppose the armature motion, a larger energy requirement is necessarily needed.

SUMMARY OF THE INVENTION

It is an object of the invention to provide an improved valve slack adjuster for an electromagnetic actuator which avoids the above-discussed disadvantages.

This object and others to become apparent as the specification progresses, are accomplished by the invention, according to which, briefly stated, the electromagnetic actuator includes a housing; two spaced electromagnets disposed in the housing and having respective pole faces oriented toward one another; an armature movable between the pole faces; an opening spring and a closing spring exerting oppositely directed forces to the armature; a supply arrangement for delivering hydraulic oil under pressure; and an armature stem affixed to the armature and having a free end oriented toward a free end of a valve stem of an engine valve of an internal-combustion engine. The valve stem and the armature stem are urged toward one another by the opening and closing springs. The armature stem is provided with a channel adapted to be supplied with hydraulic oil from the supply arrangement. Further, a guide is provided for supporting and guiding the armature stem in displacements thereof. A piston-and-cylinder unit, including a cylinder chamber, is disposed between the free and of the armature stem and the free end of the valve stem for transmitting displacement forces from the armature stem to the valve stem by the piston-and-cylinder unit. A valve assembly is provided which has a first state in which hydraulic communication is maintained between the supply arrangement and the cylinder chamber via the channel in the armature stem and a second state in which hydraulic communication is blocked between the supply arrangement and the cylinder chamber.

According to the invention, a piston-and-cylinder unit forming a hydraulic valve slack adjuster is integrated into the electromagnetic actuator so that the actuator, with the valve clearance adjuster, constitutes a structure which may be removed as a unit from the combustion engine. The piston-and-cylinder unit disposed between the armature stem and the engine valve stem is filled with oil (hydraulic fluid) from the oil channel provided in the armature stem and acts as a rigid force-transmitting body in the closed state of the valve assembly. Accordingly, the force which is to be transmitted from the armature to the engine valve during the opening motion may be transferred without any change of distance between the armature stem and the engine valve stem. The valve assembly of the slack adjuster according to the invention ensures that the leakage oil losses of the piston-and-cylinder unit as well as temperature and/or wear-caused distance variations in the system are always compensated for and, accordingly, the setting piston which transfers the setting forces from the armature to the engine valve, is at all times in a firm engagement with the end of the valve stem. Expediently, the valve arrangement is designed such that resupply of pressurized oil may occur in each instance when the engine valve is in the closed position.

While it is in principle possible to arrange the piston-and-cylinder unit on the armature stem, according to a particularly advantageous feature of the invention the piston-and-cylinder unit is formed essentially by the end of the armature stem configured as a piston and a cylinder sleeve inserted thereon. This arrangement results in a reduction of the structural volume and the mass of the components, whereby the mass-generated forces are reduced as well. Since the piston is formed by the armature stem externally of the stem guide, no higher friction forces appear because only the usual friction between the armature and its guide is present.

According to a particularly advantageous feature of the invention, for reducing the friction forces, the armature stem is disposed solely in the yoke body of that electromagnet which is oriented towards the internal-combustion engine, that is, which is closer to the engine valve than the other electromagnet.

According to a further advantageous feature of the invention, the guiding mechanism includes a guide sleeve disposed in a bottom plate of the housing and extending above a centering collar. The lateral port opening of the oil channel provided in the armature stem is situated in the guide sleeve. Such a sleeve arrangement may be inserted into a bore in the laminated yoke of the electromagnet. Such a yoke bore need not be made with high precision because the sleeve, as a prefabricated precision component, ensures a proper alignment with its centering collar and a correspondingly precise receiving socket in the bottom plate of the housing.

In accordance with a further advantageous feature of the invention, the valve assembly includes a plunger valve which is formed by a channel opening (port) of the pressurized oil channel in the armature stem and a valve opening (port) which is formed in the guide for the armature stem and which is coupled with the pressurized oil supply. The valve assembly further includes a check valve which is arranged at the armature pin and which opens only toward the piston-and-cylinder unit. The port in the guide wall is expediently so arranged that a communication with the cylinder chamber is provided when the armature engages the closing magnet and the engine valve engages its valve seat and is thus in the closed position. In such a position pressurized oil may be resupplied to the piston-and-cylinder unit from the pressurized oil supply if, because of leakage losses or distance variations of the components with respect to one another the spacing between the piston-and-cylinder unit and the end of the valve stem has changed. Upon such an occurrence the pressurized oil supply opens the check valve and resupplies a corresponding amount of oil. The check valve prevents an oil outflow if the armature is moved in the opening direction against the force of the closing spring, and in the piston-and-cylinder unit a corresponding pressure has built up. As soon as the port in the armature stem has passed the port in the stem guide, such an oil outflow too, is shut off.

In accordance with a further feature of the invention, on that side of the housing which is oriented towards the internal-combustion engine, a spring seat disk for the opening spring is displaceably supported by a setting device in the housing for movement in the direction of motion of the armature (and the armature stem). The setting device is integrated in the electromagnetic actuator and permits an adjustment of the position of the armature relative to the pole faces of the electromagnets. In this arrangement the return springs may be arranged in a "spring box" on that side of the actuator which is oriented towards the internal-combustion engine. The opening spring in this construction constitutes a part of the actuator while the closing spring is connected directly with the valve stem, and during a removal or replacement of the actuator remains connected to the internal-combustion engine.

According to a further advantageous feature of the invention, the setting device has a wedge face at the spring seat disk and a counter wedge face on a setting slide. The setting slide is expediently guided on the bottom plate of the actuator housing and may be shifted and immobilized by a setscrew.

In accordance with a further advantageous feature of the invention, for supporting the opening spring an axial bearing is provided which may be a needle bearing expediently arranged at the spring seat disk. Since conventionally as an opening spring a coil compression spring is used, by means of the axial bearing a "winding" or lateral (radial) motion appearing during lengthening or shortening of the compression spring may be isolated from the armature. Thus, such a winding motion cannot be transferred to the armature so that a collision of the armature with the housing walls in rectangular actuators having rectangular armatures is not possible. It is an advantage of such a structure that the spring seat disk is held by the setting device by friction and thus all relative motions caused by the "winding motion" of the opening spring are compensated for by the axial bearing and, as a result, the armature is reliably guided only in an axial direction.

BRIEF DESCRIPTION OF THE DRAWING

The sole FIGURE is an axial sectional view of a preferred embodiment of the invention.

DESCRIPTION OF THE PREFERRED EMBODIMENT

Turning to the FIGURE, the electromagnetic actuator illustrated therein essentially includes two electromagnets 1 and 2 which are disposed in a housing 3 and are held at a distance from one another by means of spacers 3.1. The electromagnet 1 has a pole face 4.1 which is oriented toward the pole face 4.2 of the electromagnet 2. Between the two pole faces 4.1 and 4.2 an armature 5 is disposed which has an armature stem 6 guided in a guide 7. The electromagnet 1 constitutes a closing magnet whereas the electromagnet 2 constitutes an opening magnet. In the illustrated embodiment only a single guide 7 is provided which is situated in the opening magnet 2 and is formed by a guide sleeve 7.1 inserted into a bottom plate 3.2 of the housing 3 and passing through the opening magnet 2. By virtue of this construction the conventional guide arrangement usually provided in the closing magnet, that is, in the electromagnet 1, is dispensed with.

The armature stem 6 guided only in the opening magnet 2 is connected by means of a bell-shaped support 8 with a resetting spring 9 which constitutes an opening spring and which is countersupported by a spring seat disk 10 at the bottom plate 3.2. The free end 6.1 of the armature stem 6 passing through the spring seat disk 10 exerts a force on the free end 11 of the stem 12 of an engine valve which is guided in an only symbolically shown cylinder head 13 of an internal-combustion engine. A resetting spring 14 which constitutes a closing spring and which is supported by a spring seat thimble 12.1 exerts a force on the engine valve in the closing direction. The resetting spring 14 and the resetting spring 9 exert their force in opposite directions, so that when the electromagnets are in a de-energized state, the armature 5 assumes its position of rest between the two pole faces 4.1 and 4.2 of the two electromagnets 1 and 2. The FIGURE depicts the engine valve in its open position. The actuator may be taken out without disassembling the cylinder head.

If the two electromagnets 1 and 2 are alternatingly energized, the armature 5 alternatingly arrives at the pole faces 4.1 and 4.2 of the respective electromagnets 1 and 2 and, accordingly, the engine valve is, for the duration of the energization, held in the open position (engagement at the pole face 4.2 of the electromagnet 2) against the force of the closing spring 14 and in the closed position (engagement at the pole face 4.1 of the electromagnet 1) against the force of the opening spring 9.

The electromagnetic actuator constitutes a structural unit which is composed of modular, prefabricated elements. The two electromagnets 1 and 2 are essentially formed of respective yoke bodies 15 which carry a non-illustrated coil and which are inserted into the housing 3. The base plate 3.2 of the housing 3 is provided with a receiving bore 3.3.

In the illustrated embodiment, each yoke body 15 is formed by a rectangular element which is composed of a plurality of individual sheet metal laminae fixedly connected to one another, for example, by laser welding. The yoke body 15 is provided with two parallel grooves into which two legs of a rectangular coil are respectively inserted. The bottom leg of the coil which extends on the outside of the yoke body 15 is laterally covered by the housing 3.

The guide sleeve 7.1, acting as a cylinder, is inserted into the yoke body 15 of the electromagnet 2. The armature stem 6 fixedly coupled with the armature 5 is guided in the guide sleeve 7.1 provided with a centering collar 7.2 which is inserted in the receiving bore 3.3 of the base plate 3.2 and projects into the yoke body 15.

The armature stem 6 is provided with an axial channel 6.2 which has an opening at the free stem end. That end of the armature stem 6 which is oriented towards the stem 12 of the engine valve is formed as a piston 16 received in a closed cylinder 17 whose length is so dimensioned that if the engine valve is in a closed position, that is, when the armature 5 lies against the closing magnet 1, between the piston 16 and the bottom of the cylinder 17 a cylinder chamber is formed. The cylinder chamber of the cylinder 17 communicates through a valve assembly with a hydraulic oil supply from which the cylinder chamber may be filled with hydraulic oil. In the closed position of the valve assembly, the opening motion of the armature 5 may be transmitted to the free end 11 of the valve stem 12 by the hydraulic oil in the chamber of the cylinder 17, since the hydraulic oil is held captive in the cylinder chamber and therefore acts as a rigid body.

When during the operation of the electromagnets the opening magnet 2 is de-energized and the closing magnet 1 is energized, the armature 5, together with the engine valve is moved from its illustrated open position until its mid position by the biased closing spring 14, and thereafter, urged by magnetic forces, the armature 5 is moved into engagement with the pole face 4.1 of the closing magnet 1. Upon this occurrence the engine valve has become seated and is thus in its closed position. The above-described valve assembly between the valve stem 12 and the armature stem 6 ensures that in such a position any distance changes between the piston-and-cylinder unit at the armature stem 6 and the end 11 of the valve stem 12 are compensated for and thus a clearance-free connection between the armature 5 and the engine valve is maintained.

The guide sleeve 7.1 inserted in the laminated yoke body 15 is, in the region occupied by the armature stem 6, provided with a port 18 which is disposed such that in the closed position of the engine valve the port 18 is in alignment with the port 19 of the channel 6.2 provided in the armature stem 6 and thus the port 18 communicates with the channel 6.2. If the armature 5 moves in the direction of the pole face 4.2 of the opening magnet 2, the outer surface of the armature stem 6 closes the port 18 and thus hydraulic oil has no access to the cylinder 17 via the channel 6.2.

Thus, the armature stem 6, the port 19 of the channel 6.2, the guide sleeve 7.1 and the port 18 together constitute a plunger valve which, dependent on the position of the armature stem 6 relative to the guide sleeve 7.1, establishes or interrupts hydraulic communication between a hydraulic oil supply conduit 20 and the chamber of the cylinder 17. When the plunger valve is closed, oil cannot escape from the cylinder 17 so that the armature motion may be transmitted to the free end of the valve stem 12 without any distance changes.

To prevent oil from flowing from the cylinder 17 when the valve port 18 is open, a check valve 21, such as a ball valve is provided which permits a flow only in the direction of the chamber of the cylinder 17. The check valve 21 is situated at the outlet of the channel 6.2 in the cylinder 17 and is thus integrated in the actuator. It is also feasible to provide such a check valve in the supply conduit 20.

The spring seat disk 10 has on its side oriented towards the base plate 3.2 a conical surface 10.1 which engages corresponding wedge faces of two oppositely shiftable setting slides 23 and 24 supported on the base plate 3.2. The setting slide 24 is provided at its free, upturned end with a threaded bore through which a setscrew passes and by means of which the two setting slides 23 and 24 may be shifted transversely to the length of the armature stem 6 in opposite directions relative to one another. Since the spring seat disk 10 may be shifted parallel to the direction of motion of the armature stem 6 by the camming action between the slides 24, 25 and the spring seat disk 10, the bias of the opening spring 9 may be changed and thus the central position of the armature 5 between the two pole faces 4.1 and 4.2 may be adjusted. Thus, the spring seat disk 10 together with its cone surface 10.1 and the setting slides 23, 24 with the setscrew 25 constitute a setting device.

The spring seat disk 10 is, at its side oriented towards the opening spring 9, provided with an axial bearing 26 such as a needle bearing which supports an end of the opening spring 9. Such a needle bearing 26 for supporting the opening spring 9 may also be provided on the bell-shaped spring support component 8. The needle bearing 26 prevents any "winding motion" of the opening spring 9 which is constituted by a coil spring, from being transferred to the armature 5. The end of the opening spring 9 which is supported by the axial bearing 26 may freely rotate relative to the spring seat disk 10 during axial motion of the system. In this manner a collision of a rectangular armature 5 with the spacer 3.1 is securely prevented.

It will be understood that the above description of the present invention is susceptible to various modifications, changes and adaptations, and the same are intended to be comprehended within the meaning and range of equivalents of the appended claims.

What is claimed is:

1. An electromagnetic actuator combined with an engine valve of an internal-combustion engine for operating said engine valve; said engine valve including a valve stem having a free end; said electromagnetic actuator comprising (a) a housing;

(b) two spaced electromagnets disposed in said housing and having respective pole faces oriented toward one another;

(c) an armature movable between said pole faces;

(d) an opening spring and a closing spring exerting oppositely directed forces to said armature;

(e) supply means for delivering hydraulic oil under pressure;

(f) an armature stem affixed to said armature and having a free end oriented toward the free end of said valve stem; said valve stem and said armature stem being urged toward one another by said opening and closing springs; said armature stem being provided with a channel adapted to be supplied with hydraulic oil from said supply means;

(g) a guide for supporting said armature stem in displacements thereof;

(h) a piston-and-cylinder unit disposed between said free and of said armature stem and said free end of said valve stem for transmitting displacement forces from said armature stem to said valve stem by said piston-and-cylinder unit; said piston-and-cylinder unit including a cylinder chamber; and (i) a valve assembly having a first state in which hydraulic communication is maintained between said supply means and said cylinder chamber through said channel and a second state in which hydraulic communication is blocked between said supply means and said cylinder chamber; in said second state hydraulic oil is being maintained captive in said cylinder chamber.

2. The electromagnetic actuator as defined in claim 1, wherein said piston-and-cylinder unit comprises a piston formed on an end portion of said armature stem and a cylinder sleeve receiving said piston for sliding motions therein.

3. The electromagnetic actuator as defined in claim 1, wherein each said electromagnet has a yoke; further wherein one of said electromagnets is situated closer to said engine valve than the other of said electromagnets; said guide being provided solely in the yoke of said electromagnet situated closer to said engine valve.

4. The electromagnetic actuator as defined in claim 1, wherein said guide comprises a guide sleeve slidingly receiving said armature stem; said housing having a bottom plate and said guide sleeve having a centering collar inserted in said bottom plate.

5. The electromagnetic actuator as defined in claim 1, wherein said valve assembly comprises (a) a first port provided in said armature stem and being in a continuous communication with said channel;

(b) a second port provided in said guide and being in a continuous communication with said supply means; in said first state of said valve assembly said first and second ports being in alignment with one another and in said second state of said valve assembly said first and second ports being out of alignment with one another; and (c) a check valve controlling the flow of hydraulic oil in said channel and being arranged to open solely in a direction in which a flow of hydraulic oil is allowed from said channel toward said cylinder chamber.

6. The electromagnetic actuator as defined in claim 5, wherein said check valve is arranged at an opening of said channel; said opening merging into said cylinder chamber.

7. The electromagnetic actuator as defined in claim 1, further comprising (j) a spring seat disk supporting an end of said opening spring; and (k) a setting mechanism for supporting said spring seat disk and for adjusting said spring seat disk parallel to the direction of motion of said armature between said pole faces; said setting mechanism being secured to said housing.

8. The electromagnetic actuator as defined in claim 7, wherein said setting mechanism comprises (a) a setting slide mounted on said housing and movable transversely to said direction of motion of said armature;

(b) means for displacing and immobilizing said setting slide;

(c) a first wedge face carried on said setting slide; and (d) a second wedge face carried on said spring seat disk; said first and second wedge faces being in engagement with one another and causing said spring seat disk to be shifted parallel to said direction of motion by camming action between said first and second wedge faces upon displacement of said setting slide.

9. The electromagnetic actuator as defined in claim 1, further comprising an axial bearing supporting said opening spring for preventing radial motions of said opening spring from being transmitted to said armature.

* * * * *

UNITED STATES PATENT AND TRADEMARK OFFICE

CERTIFICATE OF CORRECTION

PATENT NO. : 6,089,197
DATED : July 18, 2000
INVENTOR(S) : Holger Lange et al.

It is certified that error appears in the above-identified patent and that said Letters Patent is hereby corrected as shown below:

Title page,
Item [30], Foreign Application Priority Data should read:

-- June 16, 1998 Germany 198 26 832.7 --.

Signed and Sealed this

Fifth Day of March, 2002

*Attest:*

*Attesting Officer*

JAMES E. ROGAN
*Director of the United States Patent and Trademark Office*